US007515068B2

(12) United States Patent
Tyburski

(10) Patent No.: US 7,515,068 B2
(45) Date of Patent: Apr. 7, 2009

(54) VEHICLE AXLE SENSOR

(75) Inventor: Robert M. Tyburski, Locust Grove, VA (US)

(73) Assignee: Traffic Monitoring Services, Inc., Locust Grove, VA (US)

( * ) Notice: Subject to any disclaimer, the term of this patent is extended or adjusted under 35 U.S.C. 154(b) by 232 days.

(21) Appl. No.: 11/476,676

(22) Filed: Jun. 29, 2006

(65) Prior Publication Data

US 2007/0013554 A1 Jan. 18, 2007

Related U.S. Application Data

(60) Provisional application No. 60/697,948, filed on Jul. 12, 2005.

(51) Int. Cl.
*G08G 1/01* (2006.01)

(52) U.S. Cl. ..... 340/933; 340/941; 377/9; 200/86 A; 200/86 R; 701/117; 701/118

(58) Field of Classification Search ..... 340/933, 340/941; 377/9; 200/86 A, 86 R, 511; 701/117, 701/118; 324/654
See application file for complete search history.

(56) References Cited

U.S. PATENT DOCUMENTS

| | | | | |
|---|---|---|---|---|
| RE18,507 | E | 6/1932 | Morris | |
| 1,889,602 | A | 11/1932 | Hill | |
| 1,928,472 | A | 9/1933 | Wilcox, Jr. | |
| 1,950,490 | A | 3/1934 | Geer et al. | |
| 2,077,924 | A | 4/1937 | Geer et al. | |
| 4,971,638 | A * | 11/1990 | Bickley et al. | 156/48 |
| 5,239,148 | A | 8/1993 | Reed | |
| 5,360,953 | A * | 11/1994 | Reed | 200/86 A |
| 5,463,385 | A * | 10/1995 | Tyburski | 340/933 |
| 5,710,558 | A * | 1/1998 | Gibson | 340/933 |
| 6,300,883 | B1 | 10/2001 | Tyburski et al. | |
| 6,326,902 | B1 | 12/2001 | Tyburski | |
| 6,417,785 | B1 | 7/2002 | Tyburski | |
| 6,469,266 | B2 | 10/2002 | Taylor | |
| 6,492,604 | B1 | 12/2002 | Maeder et al. | |
| 6,744,378 | B1 | 6/2004 | Tyburski | |
| 2002/0050917 | A1 * | 5/2002 | Taylor | 338/47 |

* cited by examiner

*Primary Examiner*—Jeff Hofsass
*Assistant Examiner*—Kerri L McNally
(74) *Attorney, Agent, or Firm*—Jim Zegeer

(57) ABSTRACT

A roadway vehicle sensor includes a coextrusion having a linear conductive section and a linear non-conductive section forming a vehicle deformable closed housing. The linear conductive section has an inwardly projecting conductive plunger along the length thereof which is fused to wedge removal arms. The linear non-conductive section has a pair of inwardly projecting insulating wings having wing tips spaced apart a distance defining a plunger gap. The insulating wings also define a contact chamber into which the plunger protrudes only upon deformation of the vehicle deformable housing by a vehicle. Preferably, the vehicle deformable housing has a flat side on the exterior for engagement with a roadway surface. A contact assembly in the contact chamber has one or more flat conductive lane switch segment, each flat conductor lane switch segment having a width which avoids phantom switch closures.

13 Claims, 2 Drawing Sheets

VEHICLE AXLE SENSOR

REFERENCE TO RELATED APPLICATION

This application claims the benefit of provisional application No. 60/697,948, filed Jul. 12, 2005 entitled Multi-Lane Vehicle Axle Sensor.

BACKGROUND OF THE INVENTION

Various devices for counting the number of vehicles traveling on a roadway are known in the patented art. The invention described is based on the principle of an "active high impedance" switch closure. The majority of the prior art in this category rely in the contact members to be separated by non-conductive material or embedded in either a non-conductive or conductive material in order to separate the lane signals. Most are not commercially successful due to high manufacturing costs, difficulties in installation procedures, poor performance and short usable life. U.S. Pat. No. 5,360,953 is a good example of an overly complex arrangement of parts and high labor content to make one multi-lane sensor. Its poor acceptance in the traffic industry is due in part because of its high manufacturing cost poor performance due to phantom switch closures caused by rubber extrusion bounce (sensor bounce) and the safety issue of making an installation. Due to the multi-layers of conductive and non-conductive molded assemblies, wire and the outer rubber enclosure, the overall height of the completed assembly is relatively massive and dense causing vehicle suspension shock when a vehicle traverses the sensor in the roadway. Also, reliability becomes a serious factor when consideration the numerous numbers of solder connections involved in the assembly process.

BRIEF SUMMARY OF THE INVENTION

The object of the present invention is to provide an improved roadway sensor for a vehicle axle sensor, particularly a multi-lane vehicle axle sensor.

Another object of the invention is to provide a roadway sensor switch which is substantially immune to "phantom switch closure" caused by "sensor bounce."

Another object of the invention is to provide an improved roadway sensor that can be installed as easily and safely as a pneumatic "road-tube."

According to the invention, a tubular coextrusion having a linear conductive portion and a linear non-conductive portion are coextruded so that the sections form a vehicle deformable closed tubular housing with mutually adjoining edges of the linear portions being fused during extrusion to form a vehicle deformable tubular housing.

The coextrusion has a conductive linear section which has an inwardly projecting protrusion or plunger. The non-conductive portion of the coextrusion has a pair of insulating wings having tips spaced apart a distance to define a protrusion or plunger gap or passage. The closed tubular housing also has a contact chamber below the insulating wings into which the conductive plunger projects when the vehicle deformable housing is engaged by a vehicle. The contact chamber is completely below the tip of the conductive protrusion or plunger so that if there is any vibration or bouncing of the roadway sensor or the contact members in the lower contact housing are precluded from contacting the tip of the plunger which is spaced a distance above the bottom of the protrusion gap or passage. Each of the contact members in the lower contact housing are flat and have an effective width so that any bounce of the roadway sensor does not permit the lower electrical contact members in the contact chamber to move past the bottom of the protrusion gap or passage and is precluded from making electrical contact with the protrusion or plunger thereby avoiding "phantom switch closure." A flat side is formed on the coextrusion to define a roadway engagement surface. For a multi-lane axle sensor, the coextrusion is simply extended for a multiple of the lanes that it is required to cross, for instance, plus extensions for securement to a roadway.

The sensor has a high degree of flexibility so that the sensor assembly can be wound up on a reel so that it can be easily dispensed from a dispensing platform, thereby reducing the time to install and retrieve the sensor from the roadway.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1A:
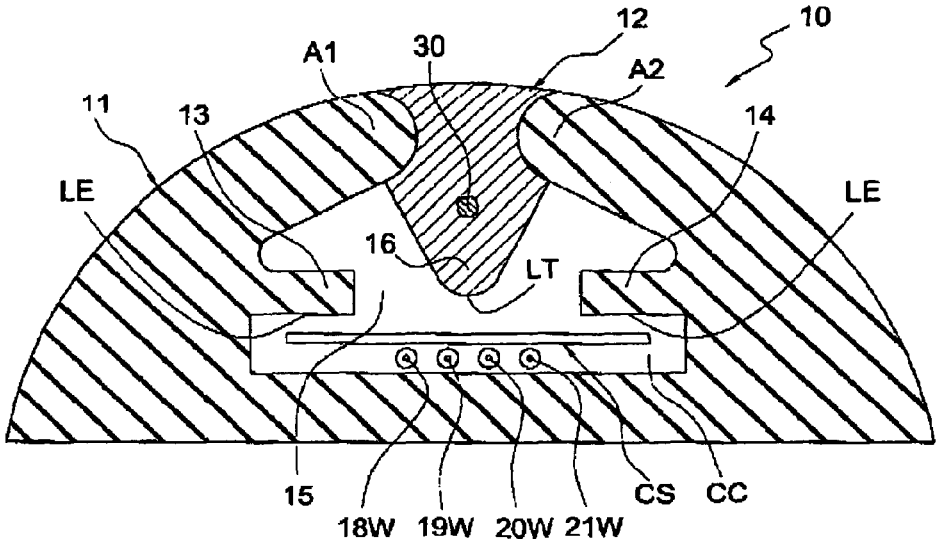
FIG. 1A shows a schematic end view of a roadway sensor assembly incorporating the invention.

Referring to FIG. 1A, a one-piece tubular silicone rubber coextrusion 10 comprising a non-conductive silicone rubber 11 and a conductive silicone rubber 12. Other suitable materials may be used to make the coextrusion. Both rubber materials have a hardness of 80 durometer on the Type A scale. The linear conductive silicone rubber section 12 is formulated by mixing carbon particles with the non-conductive silicone rubber to achieve the required resistive values and proper bonding characteristics during the vulcanizing process when these two different rubber compounds are mutually joined and fused together during the coextrusion manufacturing process to form a deformable, closed housing. The inwardly projecting insulating wings 13 and 14 define a gap 15 through which the conductive contact protrusion or plunger 16 projects upon deformation of the housing. The rubber wedge removal spring arms A1, A2 serve two important sensitivity functions: (1) significantly improve the response time to allow for generating accurate axle signals when two adjacent axles are very close together (example, small double-axle trailers); and (2) make possible the accurate sensing of very light weight vehicles and/or vehicles traveling at a high rate of speed that are partially airborne due to undulations in the roadway. The non-conductive rubber can be formed as the complete exterior and the conductive rubber be coextruded on the interior thereof.

Figure 1B:
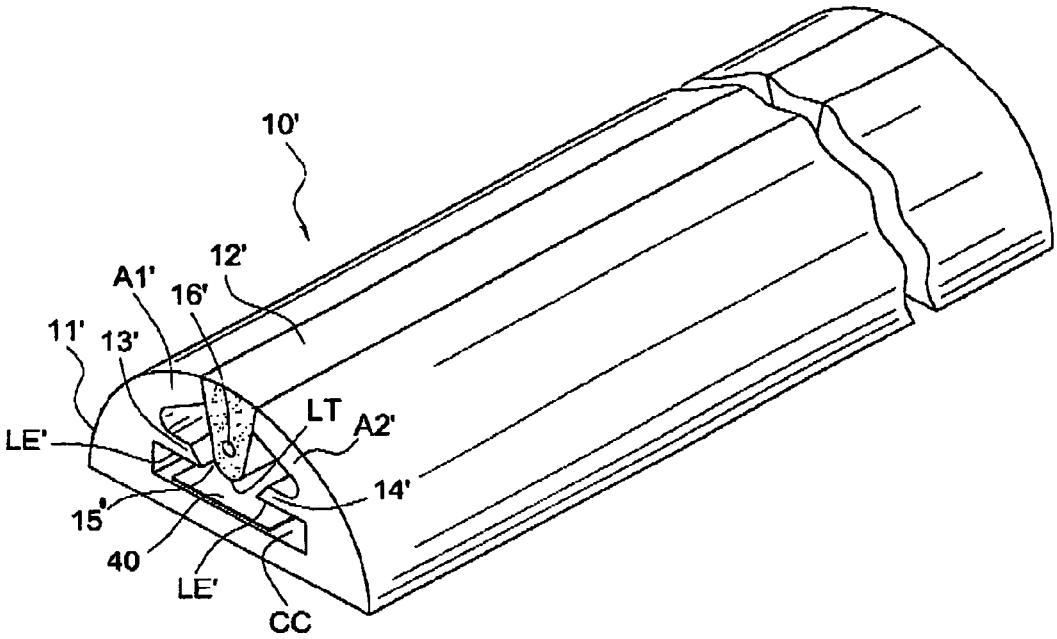
FIG. 1B is an isometric view showing a preferred embodiment of cross-section of a roadway sensor assembly incorporating the invention.

In the embodiment shown in FIG. 1B, corresponding components are identified by primed numerals. In this embodiment, the gap 15' between the tip and a wing 13' and 14' is made smaller and the wing tips are beveled.

The conductive plunger or protrusion 16 is spaced a predetermined distance above the contact chamber CC so that the lower tip LT of the contact protrusion or plunger 16 is always above the lower edge LE of the wing tips surfaces so that the wide conductive contact strip CS is never contacted by the lower tip LT during any bouncing or vibration of the sensor thereby eliminating phantom switch closures. For a single-lane sensor, a single elongated flat contact strip CS may be provided in the bottom of the contact chamber CC; and it is not necessary that it be adhered to the bottom of the contact chamber CC, but it can be if desired.

The electrical contact assembly CA components in the lower contact chamber CC are preferably flat and may be mounted on a flexible carrier so that it can be easily installed in the manner described later herein. Each flat contact strip has a width such that it cannot protrude into the plunger gap when there is bouncing or vibration of the sensor assembly on the roadway.

In one embodiment, the internal electrical component parts in the contact assembly are installed after the extrusion process and comprises, for a four-lane highway, four each conductive metal substrates, 18, 19, 20 and 21, 9' L×½" W×0.006" T, constituting contact strips, four (4) insulated signal carrying wires 18W, 19W, 20W and 21W, each connected to respective ones of the metal substrates or contact strips 18, 19, 20 and 21 using copper conductive adhesive tape (or other conductive securements). A bare copper wire 30 is inserted into the conductive silicone rubber plunger 16. The conductive silicone rubber has approximately three ohms/cm of resistance. A typical two-lane sensor will exhibit between 780-2,020 ohms of resistance when a vehicle traverses the assembled sensor. A typical four lane sensor with ten feet of roadside shoulder extension will exhibit between 1,800-5,400 ohms when the plunger 16 makes contact with its corresponding contact in the contact assembly.

Figure 2A:
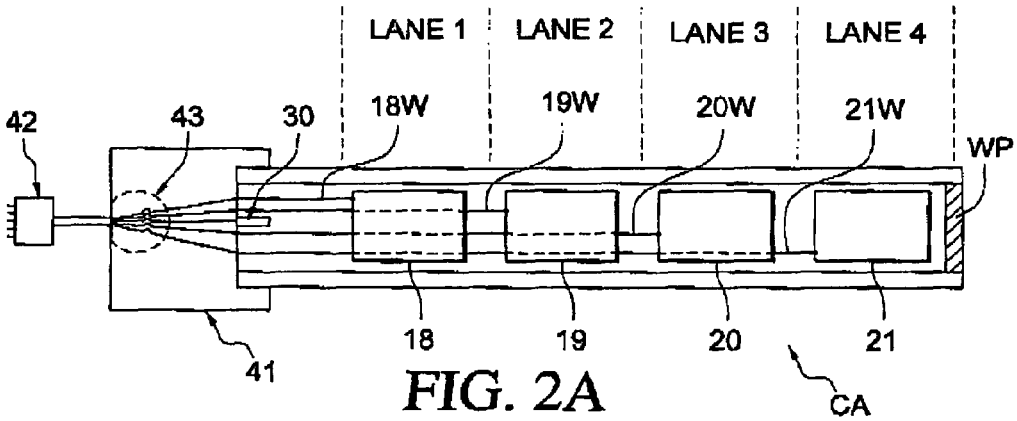
FIG. 2A is a top view of the active components of the roadway sensor assembly.

FIG. 2A shows the top view of the assembled four-lane sensor stretched out on a table.

Figure 2B:
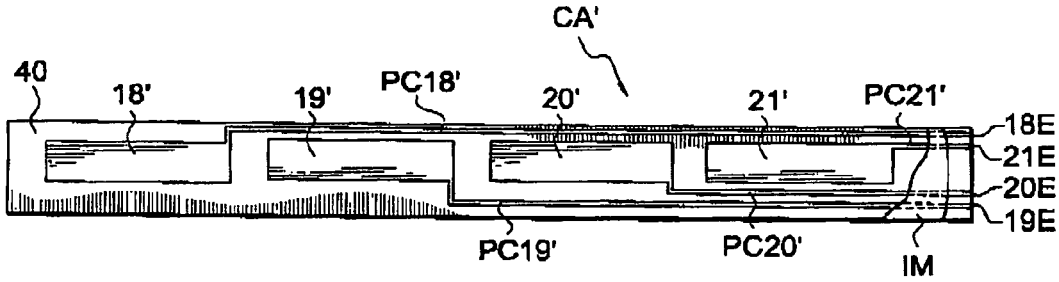
FIG. 2B is a top view of a further embodiment of the active components.

As shown in FIG. 2B, the contact assembly CA' for the lower contact chamber can be made on a thin flexible printed circuit substrate 40, such as Mylar™, without any soldering or contact splicing. In this embodiment, printed circuit (copper) electrical contacts 18', 19', 20' and 21' have rectangular shapes that are wide enough so that they bridge or span the gap 15 between the ends of the wing tips 13 and 14. This assures that there is no electrical contact during bounce or other vibration of the sensor in use, thereby completely avoiding any false signaling of any kind whatsoever. The integrally formed printed circuit wiring PC18', PC19', PC20' and PC21' are extended on flexible Mylar™ carrier substrate 40 and has each end connected to a logic counter circuit described later herein. The printed circuit wiring PC18', PC19', PC20' and PC21' may be coated with an insulating material IM.

To assemble the sensor, a vacuum pump is connected to one open end, at the other end of the silicone extrusion 10 a lightweight cotton string is fed into the center cavity of the silicone extrusion 10. The vacuum pump is then turned "on" its vacuum pulls the string to the other end. The pump is then turned off and a #24 wire is connected to the string. The string is then pulled through dragging the wire. When the wire reaches the other end it is cut loose from the string and attached to the pre-assembled wires and conductive metal substrates as shown in FIG. 2A or the printed circuit assembly shown in FIG. 2B. The assembly is then pulled through the contact chamber CC into proper position. The wire ends will be exposed so that an epoxy connector 43 can be made to join together the sensor wires and 5-pin connector cable and the watertight plug assembly 42. A watertight plug WP is applied to the opposing end. Four signal wires (18, 19, 20, 21 or PC18', PCl9', PC20', PC21'), one wire for each lane and a ground wire (connected to the plunger 16) is connected to the 5-conductor cable 43.

Figure 3:
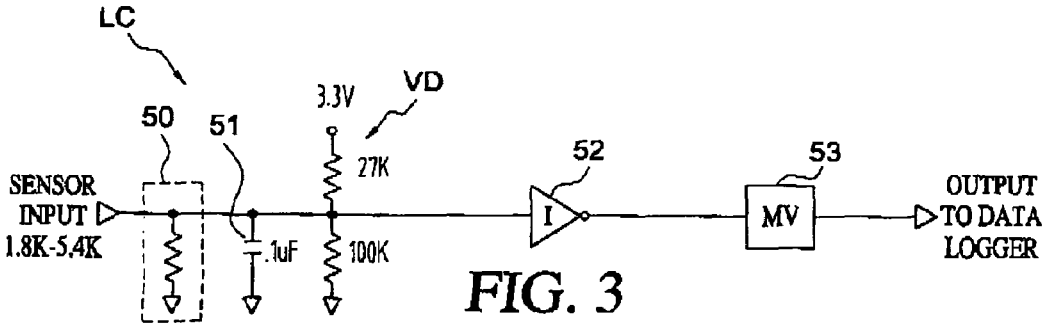
FIG. 3 shows details of the electronic processing circuitry.

FIG. 3 shows a typical electronic logic circuit LC connected to each roadway sensor lane. When capturing and storing one lane of traffic data volume, speed and classification data two logic circuits will be required, because two sensors are required. A one-lane volume only study requires only one logic circuit. When recording four lanes of volume, speed and classification data eight logic circuits are required. The switch input resistance 50 connected to the voltage divider VD of 25K and 100K will be the resistance of the sensor elements made up of the resistance of the coextrusion plunger 16, the metal substrate 18, 19, 20, 21 or PC18, PC19, PC20, PC21 and its associated signal and ground wires which amounts to a high impedance switch circuit. When the vehicle traverses the coextrusion on the roadway the plunger 16 makes contact with its metal substrate and lowers the effective values of the 100K resistor in the voltage divider circuit VD. This results in a negative lowering of the static voltage from 3 vdc to less than 1 vdc. The duration of this negative pulse will be dependent upon the speed of the vehicle and the foot-print of the tire.

The purpose of the 0.1uf capacitor 51 is to eliminate residual high voltage, low current signals generated from the insulated dielectric material on the signal conductors. The square wave at the voltage divider circuit VD varies in amplitude and rise and fall times are slow. This square wave is coupled to a non-hysteresis inverter 52 in order to convert a variable amplitude pulse to a standard full voltage CMOS signal. The output of the inverter is coupled to a multivibrator 53 that generates a 1msec square wave with fast rise and fall times that will easily interface with the Data logger for time stamp processing and subsequent storage in its static memory module as shown in U.S. Pat. No. 6,300,883 B1.

While the invention has been described in relation to preferred embodiments of the invention, it will be appreciated that other embodiments, adaptations and modifications of the invention will be apparent to those skilled in the art.

What is claimed is:

1. For use in a roadway vehicle sensor, a coextrusion having a linear conductive section and a linear non-conductive section, said non-conductive section having a flat side, said sections forming a vehicle deformable closed housing with mutually adjoining edges of said linear sections being fused to form said vehicle deformable closed housing and wherein said linear conductive section has a downwardly projecting contact protrusion, and wherein said contact protrusion is centered relative to said flat side, and wherein said linear non-conductive section has a pair inwardly projecting coplanar insulating wings having wing tips spaced apart a distance defining a contact protrusion passage.

2. The coextrus ion defined in claim 1 wherein said insulating wings define a contact chamber into which said contact protrusion protrudes upon deformation of said vehicle deformable housing by a vehicle.

3. A roadway sensor comprising the vehicle deformable closed housing defined in claim 1 including at least one conductive metal member in said closed housing and positioned such as to be electrically engaged by at least a portion of said linear conductive section upon deformation of said vehicle deformable housing.

4. A roadway sensor comprising the vehicle deformable closed housing defined in claim 2 including at least one conductive metal member in said closed housing and positioned such as to be electrically engaged by at least a portion of said linear conductive section upon deformation of said vehicle deformable housing.

5. A roadway sensor comprising a coextrusion having a linear conductive section and a linear non-conductive section, said non-conductive section having a flat side, said sections forming a vehicle deformable closed housing with mutually adjoining edges of said linear sections being fused to form said vehicle deformable closed housing and wherein said linear conductive section has a downwardly projecting contact protrusion, and wherein said contact protrusion is centered relative to said flat side including a pair of extruded spring arms, one spring arm on each side of said linear conductive section, respectively.

6. A roadway sensor comprising the vehicle deformable housing defined in claim 5 wherein said coextrusion has a hardness of 80 durometers on the Type A scale.

7. A roadway sensor comprising the vehicle deformable housing defined in claim 5 wherein said coextrusion spans multiple lanes of a roadway, and a contact assembly in the lower part of said housing, said contact assembly having one or more flat metal conductive lane segments, each flat metal conductive lane segment having a predetermined length and a width which is wider than said plunger gap to avoid phantom switch closure.

8. A roadway sensor as defined in claim 7 wherein said conductive metal member is formed as part of a printed circuit assembly.

9. A roadway vehicle sensor comprising:

a coextrusion having a linear conductive section and a linear non-conductive section, said sections forming a vehicle deformable closed housing, said linear conductive section having an inwardly projecting conductive plunger along the length thereof, said linear non-conductive section having a pair of inwardly projecting insulating wings having wing tips spaced apart a distance defining a plunger gap, said insulating wings also defining a contact chamber into which said plunger protrudes upon deformation of said vehicle deformable housing by a vehicle, said vehicle deformable housing having a flat side on the exterior for engagement with roadway surface, and a contact assembly in said contact chamber, said contact assembly having one or more flat conductive lane segment, each flat conductor lane segment having a width which is wider than said plunger gap and avoid phantom switch closures.

10. The roadway vehicle sensor defined in claim 9 wherein there is a plurality of lanes in said roadway, a corresponding plurality of flat conductor segments, and a respective signal conductor connected to each flat conductor lane segment, respectively.

11. The roadway vehicle sensor defined in claim 9 including counter circuit connected to said linear conductive section and said flat conductor lane segment.

12. The roadway vehicle sensor as defined in claim 9 wherein said contact assembly is formed as a part of a printed circuit unit.

13. For use in a roadway vehicle sensor, a coextrusion having a linear conductive section and a linear non-conductive section, said non-conductive section having a flat side, said sections forming a vehicle deformable closed housing with mutually adjoining edges of said linear sections being fused to form said vehicle deformable closed housing including means in said housing forming a contact chamber, and wherein said linear conductive section has a downwardly projecting contact protrusion, and wherein said contact protrusion is centered relative to said flat side, and wherein said means includes an inwardly projecting wing member.

* * * * *